US007284290B1

(12) United States Patent
Swezey et al.

(10) Patent No.: US 7,284,290 B1
(45) Date of Patent: Oct. 23, 2007

(54) DUAL-MODAL-SHAPE BED LOUNGE

(76) Inventors: Robert L. Swezey, 10532 Garwood Pl., Los Angeles, CA (US) 90024; Richard Swezey, 1328 16th St., Santa Monica, CA (US) 90404

( * ) Notice: Subject to any disclaimer, the term of this patent is extended or adjusted under 35 U.S.C. 154(b) by 0 days.

(21) Appl. No.: 11/240,538

(22) Filed: Sep. 30, 2005

(51) Int. Cl.
*A47C 20/00* (2006.01)
*A47C 16/00* (2006.01)
*A47C 20/02* (2006.01)
*B68G 5/00* (2006.01)

(52) U.S. Cl. ..... 5/633; 5/630; 5/632; 5/657

(58) Field of Classification Search ..... 5/633, 5/634, 630, 632, 652, 657; 292/183, 184, 292/189, 137; 297/230.1, 230.14
See application file for complete search history.

(56) References Cited

U.S. PATENT DOCUMENTS 284,632 A * 9/1883 Hartman ..... 292/183
1,250,027 A * 12/1917 Sandford, Sr. ..... 70/154
2,481,429 A * 9/1949 Kerr ..... 292/21
2,940,511 A * 6/1960 Gomes ..... 297/440.12
2,961,668 A * 11/1960 Hayes ..... 5/640
3,137,012 A * 6/1964 Halterman ..... 5/633
3,273,174 A * 9/1966 Cassini ..... 5/633
3,680,917 A * 8/1972 Harris ..... 297/452.41
4,385,782 A * 5/1983 Clark, Jr. ..... 297/440.12
4,538,310 A * 9/1985 Scott ..... 5/655
4,909,573 A * 3/1990 Barry et al. ..... 297/452.17
5,423,098 A * 6/1995 Swezey et al. ..... 5/633
5,829,830 A * 11/1998 Maloney ..... 297/230.13
5,941,599 A * 8/1999 Roberts ..... 297/115
D427,833 S 7/2000 Robinson
6,494,532 B1 * 12/2002 Brosnan et al. ..... 297/181
2005/0229315 A1 * 10/2005 Walpin ..... 5/633

* cited by examiner

*Primary Examiner*—Patricia Engle
*Assistant Examiner*—Jonathan Liu
(74) *Attorney, Agent, or Firm*—J. E. McTaggart

(57) ABSTRACT

Dual-modal-shaping capability is added as a new feature in bed lounges of the type having a fabric slip-cover enclosing foam padding on a main structure formed from plastic sheet material. User adjustment is provided for back tilt, head-rest tilt and height, arm-rest spacing, and back support location. Modal transition is provided by an internal mechanism that interlinks the two arm-rests via a weighted lock-pin that locks the arm-rests in place for normal use but that can be disengaged by merely inverting the bed lounge so the lock-pin drops out from the linkage gravitationally, thus allowing the arm-rests to be folded out to convert to an overall flat modal-shape that can be conveniently stored, e.g. under a bed or hanging in a closet. For re-deployment, when the bed lounge is manually placed in its normal modal-shape in an upright position, as the arm-rests are moved together to their normal spacing, the weighted lock-pin automatically drops back down into place so as to again lock and retain the bed lounge in its chair-like normal modal-shape.

14 Claims, 3 Drawing Sheets

DUAL-MODAL-SHAPE BED LOUNGE

FIELD OF THE INVENTION

The present invention relates to household bedding accessory furniture and more particularly it relates to a dual-modal-shape bed lounge that can be easily user-converted back and forth between (1) a chair-like normal modal-shape that provides back support to a user seated upright on a flat surface such as bed, and (2) a generally flat modal-shape for convenient storage.

BACKGROUND OF THE INVENTION

For those who spend periods of time sitting in a bed, or even on a floor or against a wall, it is important to provide proper support to the body to avoid discomfort, fatigue and/or body deformation. Ordinary cushions and pillows fail to provide necessary support, which requires a chair-like bed lounge typically with at least a back portion with two attached arm-rests, one at each side, and preferably a neck support/head-rest. To accommodate the needs of different individuals with regard to size, weight, age, etc., the bed lounge is preferably provided with several user adjustment capabilities, e.g. relating to tilt-back, arm-rest spacing, lower back support, neck-rest height and inclination.

KNOWN ART

Bedding furniture in the field of this invention has been known under such names as "bed bolster", "husband" and "study rest". Typically such items have been made entirely from foam material so that characteristically they lack support, being overly soft and flexible, and/or they are inconveniently heavy.

U.S. Pat. No. 5,423,098 to the present inventors disclosed an ergonomic BED LOUNGE™ made with a fabric cover enclosing foam padding over a main structure formed from plastic sheet material to provide the required strength while keeping the weight lighter than all-foam construction. The Bed Lounge featured back inclination adjustment, a built-in adjustable lower back pillow, a doubly adjustable neck pillow and side arm-rests whose forward portions can be adjusted for end separation.

U.S. design patent 427,823 to Robinson shows a BED PILLOW WITH ARM RESTS AND COVER.

U.S. Pat. No. 5,829,830 to Maloney discloses a removable SUPPORT INSERT FOR A HIGH CHAIR directed to positioning and supporting the upper torso of an infant seated in the high chair.

OBJECTS OF THE INVENTION

It is a primary object of the present invention to provide further advantages and improvements in bed lounges with regard to convenience of storage, in view of the three dimensional shape of known bed lounges and the fact that these are in use only for a small fraction of the time, and must somehow be stored for the great majority of the time.

It is a further object to provide a bed lounge whose normal three-dimensional modal-shape can be easily changed to a flat generally flat two-dimensional modal shape for convenience and versatility regarding storage, e.g. that can be stored unobtrusively under a bed or hanging in a closet.

It is a still further object that the bed lounge be provided with a locking system that enables the user to easily deploy the three-dimensional normal modal-shape wherein the arm-rests are made to be substantially locked in place generally perpendicular to the back portion, and to easily release the locking system and convert to the flat two-dimensional flat modal shape wherein the arm-rest locking is released so the arm-rests can be folded back to the generally flat modal-shape for purposes of convenient storage.

It is a further object that conversion back and forth between the flat modal-shape and the normal modal-shape be made easy for an ordinary unskilled individual to perform manually without the use of any tools.

SUMMARY OF THE INVENTION

The above and further objects and advantages have been realized in the present invention of improvements to the bed lounge: an internal mechanism interlinking the two arm-rests includes a weighted lock-pin that holds the arm-rests in place with the bed lounge set up for use in the normal modal-shape. The arm-rest linkage can be disengaged by merely inverting the bed lounge so that the lock-pin drops out of place from the linkage gravitationally thus unlocking and allowing the arm-rests to folded out to convert to the overall flat shape that can be conveniently stored, e.g. under a bed or hanging in a closet. For re-deployment, when the bed lounge is manually set up to its normal upright position, the weighted lock-pin automatically drops back into place engaging the arm-rest linkage so as to again lock and secure the bed lounge and its arm-rests in its chair-like normal modal-shape for usage.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
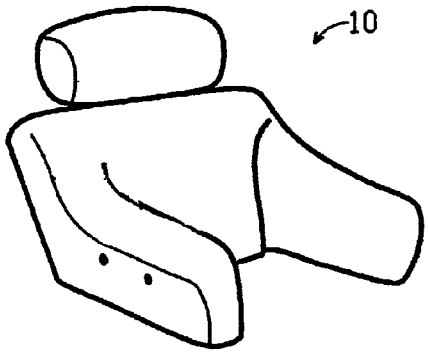
FIG. 1 is a perspective view showing the outline of a bed lounge of the present invention.

FIG. 1 shows, in a three-dimensional perspective view, an outline of a bed lounge 10 representing the external appearance of an illustrative embodiment of the present invention, which, with regard to external appearance and user adjustability is generally similar to the earlier version of the BED LOUNGE, as disclosed in U.S. Pat. No. 5,423,098 to the present inventors. However the present invention incorporates novel internal structure that enables easy conversion from the normal three-dimensional chair-like shape shown to a generally two-dimensional flat shape for purposes of convenient storage.

Figure 2:
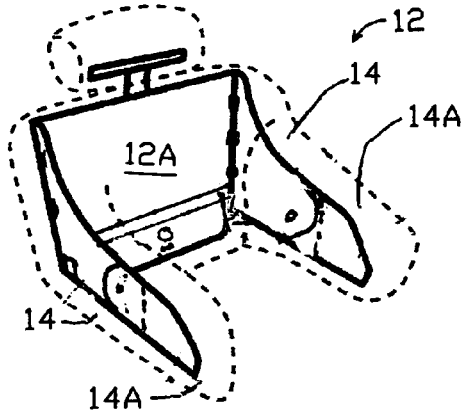
FIG. 2 is perspective view of the outline of the sheet plastic main structure of the bed lounge of FIG. 1, indicating the fabric covering in broken lines.

FIG. 2 is a perspective view showing the outline of the internal structure 12 of flat internally-corrugated sheet plastic material in the bed lounge of FIG. 1, over which padding and fabric covering are formed as shown in the broken-line outline 14 which is essentially the basic bed-lounge outline shown in FIG. 1.

Unlike the previous versions of the bed-lounge which were made to be essentially permanent in the fixed three dimensional normal usage modal-shape shown in FIG. 1, the bed-lounge of the present invention is originally stamped out from a sheet of flat material in one piece: the main body 12 that includes the three main components, i.e. the back portion 12A and the two arm-rests 14 which are each attached by a "living hinge" at the corner. A pair of arm-rest extension portions 14A, attached in a swivel manner to arm-rests 14, typically using brass eyelets, are also made adjustable for end separation by "living hinge" score lines as shown.

A locking mechanism automatically secures the bed-lounge in the normal usage modal-shape shown, but the locking can be readily released by the user to convert the bed-lounge back to its original flat shape for convenient storage.

FIGS. 3-6 show various degrees of adjustment capability that are made available to the user of bed-lounge of the present invention when deployed in the normal usage modal-shape.

Figure 3:
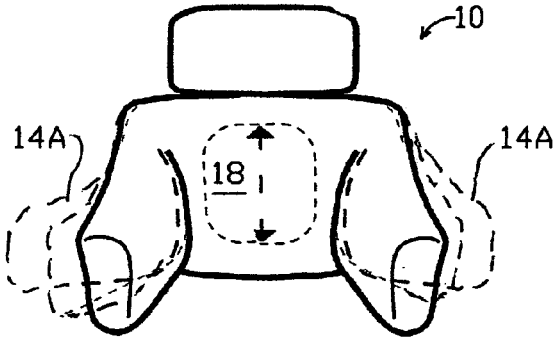
FIG. 3 is a frontal perspective view of the bed lounge of FIGS. 1 and 2, indicating in broken lines the range of adjustment of the arm-rests and the lower back pillow.

FIG. 3 shows the range of adjustment for spacing of arm-rest extension portions 14A. Also shown is the adjustable location of an internal lower back support pillow 18.

Figure 4:
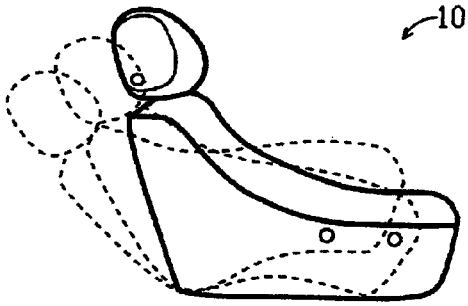
FIG. 4 is a side elevation view of the bed lounge of FIGS. 1-3 indicating broken lines the range of recline adjustment.

FIG. 4 shows the range of adjustment for tilt-back.

Figure 5:
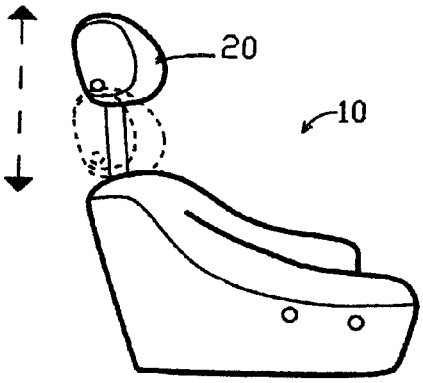
FIGS. 5 and 6 are side elevation views as in FIG. 4 indicating in broken lines the range of height and tilt adjustment of the neck support.

FIG. 5 shows the range of height adjustment for the neck support 20.

Figure 6:
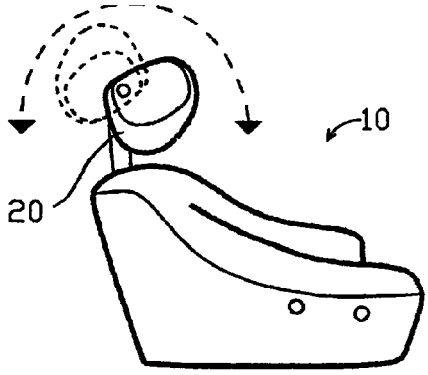

FIG. 6 shows the folding and locking range of tilt adjustment for the neck support 20.

Figure 7:
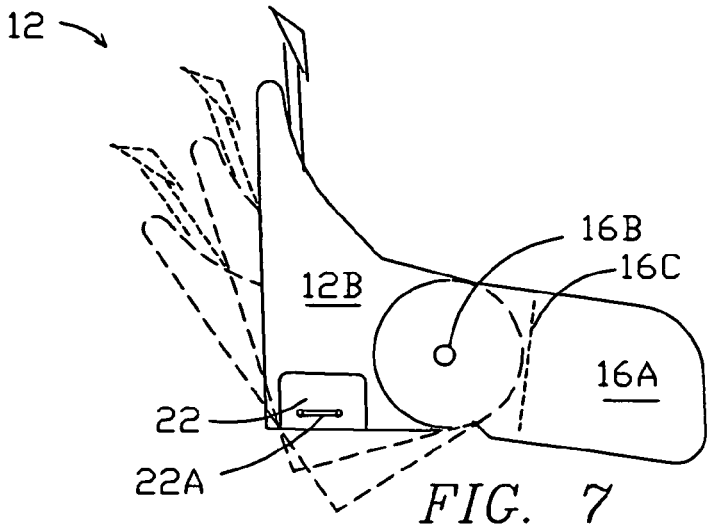
FIG. 7 is a left hand side elevation view of the main structure of FIG. 2 showing in broken lines the range of recline adjustment as in FIG. 4.

FIG. 7 is a side view of the internal structure 12 of FIG. 2 showing an eyelet 16B by which each arm-rest portion 12B is pivotally attached to an arm-rest extension portion 16A, providing the user with tilt-back adjustment (as shown in FIG. 4): two alternative tilt-back positions within the adjustment range are indicated in broken lines. A bend-line 16C scored in the sheet plastic material of extension portion 16A forms a "living hinge" that enables the forward portion 14A of each arm-rest 14 to be re-positioned by the user in a manner to adjust the arm-rest spacing as shown in FIG. 3.

At the lower left of FIG. 7, a mounting flange of a pivot bracket 22 is attached by a nylon tie strip 22A extending through a pair of holes provided in each arm-rest portion 12B.

Figure 8:
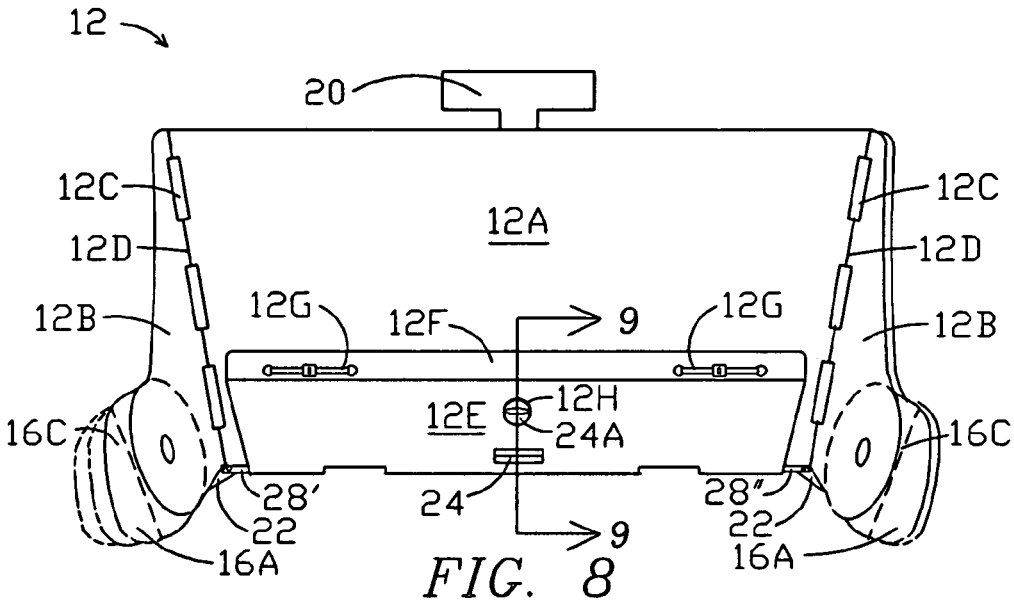
FIG. 8 is a frontal perspective view of the main structure of FIG. 2, showing in broken lines the range of adjustment for the left hand arm-rest as in FIG. 3.

FIG. 8 is a frontal view of the internal structure 12 of FIG. 2 showing neck support 20 above the back portion 12A, which extends to form the two arm-rest portions 12B. The "living-hinges" at the two corners are each configured with three cutaway segments 12C and a four-segment scored bend-line 12D, enabling the arm-rest portions 12B to be folded out flat when released by a locking mechanism associated with the two pivot brackets 22 and pivotally attached link-strips 28' and 28" located behind a sloping bottom panel 12E, exposing only the ends in this view.

Indicated at the left hand side in broken lines are two alternative arm-rest positions within the separation adjustment range of the arm-rest extension portion 16A, enabled by bend-line 16C.

At the center of sloping panel 12E, an oval opening 12H exposes the top end of a cylindrical housing 25A that contains a gravity operated lock pin. Immediately beneath is seen an exposed fastening tab of a guide plate 24 extending through an opening provided in sloping panel 12E.

Figure 9:
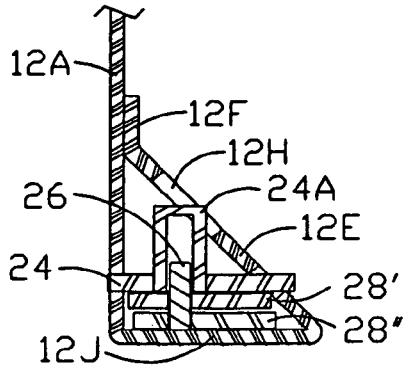
FIG. 9 is an enlarged cross-section taken at 9-9 of FIG. 8.

FIG. 9 is a enlarged cross-section taken through 9-9 of FIG. 8, showing the back portion 12A folded at the bottom and extending forward as a bottom panel 12J then folded back and up as sloping panel 12E, returning to the back portion 12A where an extending flange 12F, extending upwardly from sloping panel 12E, is attached to the back portion 12A by a pair of nylon tie strips 12G traversing holes provided in back portion 12A and flange 12F.

A pair of link-strips 28' and 28" each have one end pivotally attached to a corresponding one of the pivot brackets 22 (FIG. 8) while their opposite ends overlap and are retained in a guide plate 24, which, along with bottom panel 12J, constrains the link-strips 28' and 28" laterally while allowing them to slide longitudinally.

The normal modal-shape shown is secured by a cylindrical metal lock-pin 26, captivated in a cylindrical container 24A which is closed at the upper end and affixed to a circular opening in guide plate 24 at the lower end, as shown. Lock-pin 26 traverses a lock-hole configured in each link-strip 28' and 28" as shown, thus locking them in place and preventing them from moving longitudinally while they serve to hold arm-rest portions 12B in place as shown in FIG. 8.

Figure 10:
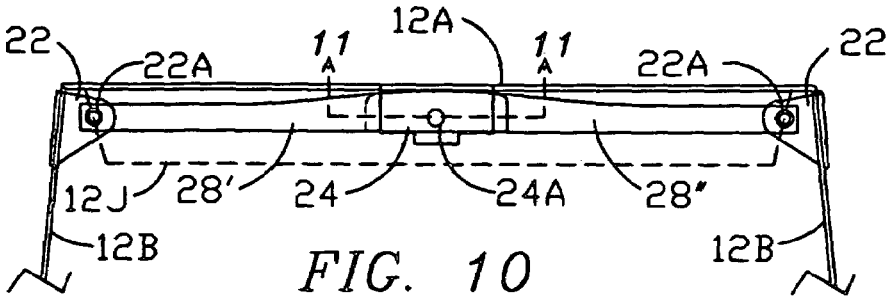
FIG. 10 is a top view of the locking linkage mechanism with the bed lounge in the normal modal-shape.

FIG. 10 is a top view of the locking mechanism as seen with sloping panel 12E removed and the outline of bottom panel 12J shown in broken lines. Link-strips 28' and 28" are seen with one end of each pivotally attached via fasteners 22A, typically brass eyelets, to a corresponding one of the pivot brackets 22 while their overlapping opposite ends are retained between guide plate 24 and bottom panel 12J, traversed by a locking pin in cylindrical container 24A, so as to hold arm-rest portions 12B in the normal mode-shape shown.

Figure 11:
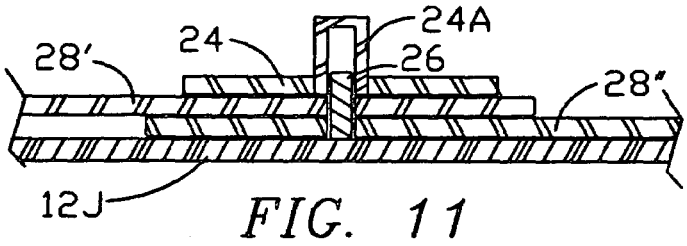
FIG. 11 is an enlarged cross-section taken through 11-11 of FIG. 10.

FIG. 11 is an enlarged cross-section taken through 10-10 of FIG. 10 showing link-strips 28' and 28" with their ends overlapping and retained between guide plate 24 and bottom panel 12J. Lock-pin 26, held down to the location shown by its own weight, traverses lock-holes in link-strips 28' and 28" so as to hold arm-rest portions 12B in place and thus secure the bed lounge 10 in the normal modal-shape as shown in FIG. 1.

Lock-pin 26 is constrained to only vertical travel by containment within cylindrical container 24A affixed to guide plate 24.

Figure 12:
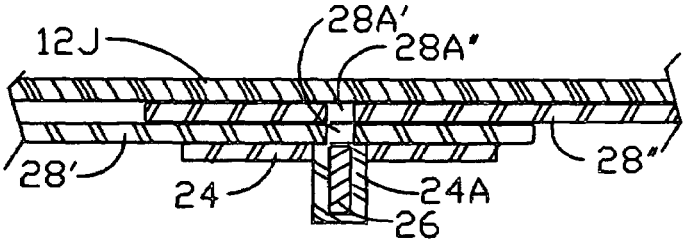
FIG. 12 shows the items of FIG. 11 inverted to disengage the lock-pin in the locking mechanism.

FIG. 12 shows the items in FIG. 11 inverted, which has caused lock-pin 26 to drop to the location shown where it is now disengaged from link-strips 28' and 28".

Figure 13:
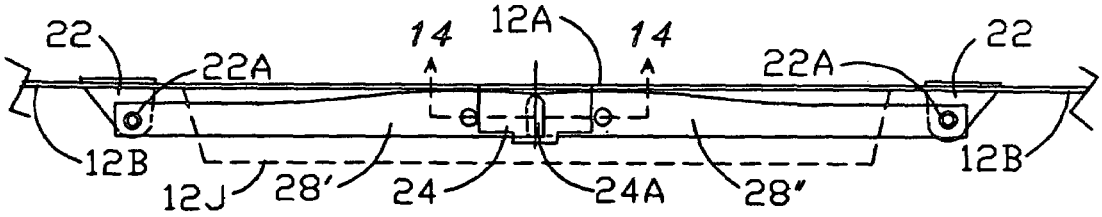
FIG. 13 shows the mechanism of FIG. 9 with the arm-rests folded out to the flat storage modal-shape.

FIG. 13 shows the items in FIG. 10 with arm-rest portions 12B having been folded out to be flat with back portion 12A, with, thus placing the bed lounge in its flat modal-shape for storage purposes.

Figure 14:
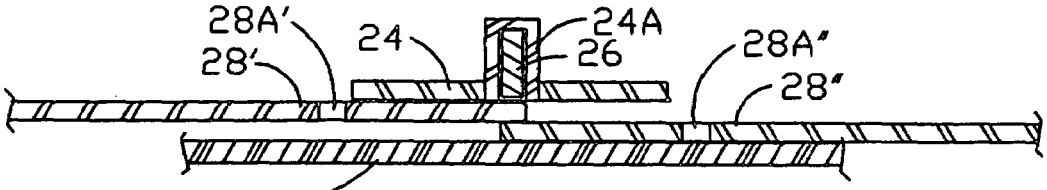
FIG. 14 is an enlarged cross-section taken through 14-14 of FIG. 13.

FIG. 14 is an enlarged cross-section view taken at 14-14 of FIG. 13, showing link-strips 28' and 28" fully extended but still overlapping and retained between guide plate 24 and bottom panel 12J.

User conversion of the lounge between the two modal-shapes requires no tools.

To convert from the normal modal-shape to the flat storage modal-shape, the bed lounge 10 (FIG. 1) is inverted by the user, causing the lock-pin 26 to drop down out of the link-strip lock-holes 28 and 28" as shown in FIG. 2, causing an audible sound, thus allowing the link-strips 28' and 28" to move longitudinally, allowing the two arm-rests 16 to be swivelled apart to where they become aligned with the back portion 12A, as shown in FIG. 13. The bed lounge 10 has thus become converted to its flat storage modal-shape ready to be stored on a horizontal surface, e.g. on a floor under a bed, or hanging vertically, e.g. in a closet.

To convert back from the flat storage modal-shape to the chair-like normal modal-state, the bed lounge is manually set up by the user to its normal upright orientation. The lock-pin 26 now rests on top of the upper link-strip 28' (FIG. 14), allowing the link-strips 28' and 28" to move longitudinally in opposite directions, constrained between guide-bracket 24 and bottom panel 12J as the user moves the arm-rests 16 toward each other. When the arm-rests 14 reach their normal location, the lock-holes 28A and 28A" in the link-strips 28' and 28" will line up with each other and with the lock-pin 26, which will then drop down through lock-holes 28A and 28A" to the position shown in FIG. 11, with an audible sound, thus securing the bed lounge in the chair-like normal modal-shape as shown in FIG. 1, ready for use. This gravity lock-pin system locks the arm-rests in place instantly, automatically, positively and securely, with no special effort, strength or skill required on the part of user other than merely setting the bed lounge up in place. Thus mode-conversion can be readily performed by anyone including users to whom the bed lounge is particularly direction, i.e. those who may be weak, handicapped or otherwise incapacitated by age, arthritis, or other afflictions, and who, absent the present invention would be over-challenged by a need to use tools in converting the bed lounge between the two modes.

The component parts of the dual-modal-shape mechanism described above in connection with FIGS. 10-14, i.e. pivot brackets 22, link-strips 28' and 28", guide plate 24 and lock pin container 24A may be made from suitably robust plastic material, e.g. ⅛" thick Lexon or polystyrene, or from metal, preferably aluminum for light weight. For the internal structure 12, which includes portions 12A-F, the recommended material is internally-corrugated sheet plastic such as polypropylene, 0.22" thick, with interior corrugations running vertically.

The dual-modal-shape principle, which has been directed beneficially as an improvement modification of the bed lounge previously patented by the inventors, can also be practiced beneficially as applied to simplified versions and other variations thereof as well as to practically any similar product in the field of endeavor having a back and a pair of arm-rests. If, additionally, a seat portion is involved, that could also be made and arranged to fold out to a flat plane in a similar manner to obtain the benefits of the dual-modal-shape capability in accordance with the principles of the present invention.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A use-operable modal-shape transition mechanism made and arranged to (1) respond to user-shaping of said bed lounge, in concluding a transition from the flat modal-shape to the normal modal-shape, by instantly and automatically locking and maintaining a perpendicular relation between said back portion and said pair of arm-rests for normal use without need for tools in the first disposition, and to (2) respond to a predetermined user-manipulation of the bed lounge, in initiating a transition of said bed lounged from the normal modal-shape to the flat modal shape, by unlocking and releasing said pair of arm-rests instantly and automatically, and thus enabling the arm-rests to be folded outwardly in a collinear relationship with said back portion, without need for tools in the second disposition, for purposes of convenient storage.

2. The dual-modal-shape bed lounge as defined in claim 1 wherein said user-operable modal-shape transition mechanism comprises:

a pair of link-strips, each having a first end pivotally attached to a corresponding one of said arm-rests and each having a second end mutually interfacing in an overlapping region, each being configured a lock-hole in the overlapping region located so as to mutually align the two lock-holes when said bed lounge is in the normal modal-shape; and a lock-pin made and arranged to enter and traverse the two lock-holes when the lock-holes are mutually aligned, and to thus lock the two link-strips together, ensuring constant spacing between said arm-rests whenever the bed lounge is in the normal modal-shape.

3. The dual-modal-shape bed lounge as defined in claim 2 wherein said lock-pin is captivated in an enclosure affixed to a guide plate in a central region of said back portion above said link-strips and is made and arranged to (1) rest in a standby mode upon one of the two link-strips in the overlapping region whenever the two lock-holes are not mutually aligned with said lock-pin, and to (2) drop gravitationally so as to enter and traverse the two link-strip lock-holes whenever the lock-holes become mutually aligned with said lock-pin, thus locking the link-strips together so as to establish and maintain the normal modal-shape.

4. The dual-modal-shape bed lounge as defined in claim 1 wherein said back portion and said arm-rests comprise:

a main support structure, including the back portion and the two arm-rests, made from flat plastic sheet material to provide strength and light weight, configured with a pair of scored lines made and arranged to enable "living hinge" folding along adjoining mutual edges of the back portion and the arm-rest portions;

foam padding covering said main support structure; and a fabric slip cover enclosing said main support structure and said foam padding.

5. The dual-modal-shape bed lounge as defined in claim 4 further comprising:

a lower back pillow, incorporated in the back region of said bed lounge, made and arranged to provide special support to a lower back region of the user's body.

6. The dual-modal-shape bed lounge as defined in claim 5 wherein said lower back pillow is captivated in a floating manner within said slip cover so as to enable the user to adjustably locate and orient said lower back pillow for user comfort.

7. The dual-modal-shape bed lounge as defined in claim 4 further comprising:

a neck pillow, for supporting a neck region of the user's body, including adjustable neck pillow support means for positioning and retaining said neck pillow located centrally above the rear portion of said bed lounge.

8. The dual-modal-shape bed lounge as defined in claim 7 wherein said neck pillow support means comprises a T-shaped spine having an upper transverse portion embedded in said neck support pillow and a downwardly-extending vertically-elongated leg portion enclosed and frictionally retained, in a passageway provided in said slip cover at a back region of said bed lounge, in a manner to allow the user to adjust said neck support pillow with regard to height.

9. The dual-modal-shape bed lounge as defined in claim 8 wherein the upper transverse portion of said spine is attached to the leg portion thereof by a living hinge, formed integrally in said spine, that allows the user to rotationally adjust the neck support pillow with regard to attitude.

10. The dual-modal-shape bed lounge as defined in claim 9 further comprising, as part of the passageway formed in said slip cover at an upper end thereof, a fabric collar frictionally engaging the leg portion of said spine.

11. The dual-modal-shape bed lounge as defined in claim 10 wherein said adjusting means further comprises fastening means for securing said neck support pillow in a selected position.

12. The dual-modal-shape bed lounge as defined in claim 4 further comprising:

a generally vertical score line configured in a mid region of each of the two arm-rest portions of the main structure, made and arranged to allow a forward portion of each arm-rest to pivot both sideways so as to provide user-adjustment of effective spacing between the two arm-rests when said bed lounge is used in the normal modal-shape.

13. A dual-modal-shape bed lounge, for supporting a user in a sitting position, comprising:

a main support structure, made from strong lightweight flat plastic sheet material, having a back portion and having, attached thereto and extending forwardly therefrom, a pair of arm-rests, one at each side thereof, said main support structure comprising a main portion, including the back portion and the two arm-rests, folded approximately perpendicularly along two rear corner fold lines between the back portion and the arm-rests;

foam padding covering said main support structure;

a fabric slip cover enclosing said main support structure and said foam padding;

a neck pillow, having a generally elliptical cross-sectional shape, disposed in an upper rear region of said bed lounge;

a T-shaped support spine having a horizontal transverse upper portion embedded in said neck pillow and integrally attached by spine hinge means to a vertically elongated lower portion extending downwardly, enclosed and frictionally engaged by a passageway configured in said slip cover at a rear central region of said bed lounge, whereby said neck pillow is supported in place and whereby the user is enabled to adjust said neck pillow with regard to height and attitude;

a lower back pillow, located on a forward-facing side of the back portion in a lower region thereof, removably contained within said slip cover in a manner to enable the user to adjust the location and orientation of said lower back pillow for user comfort;

arm-rest shaping means, in the arm-rest portions of said main support structure, enabling a forward portion of each arm-rest to be pivoted both outwardly away from each other and inwardly toward each other;

said bed lounge being made and arranged to be easily user-converted back and forth between (1) a chair-like normal modal-shape for supporting the user in a sitting position and (2) a generally flat modal-shape for convenient storage; and a user-operable modal-shape transition mechanism made and arranged to (1) respond to user-shaping of said bed lounge, in concluding a transition from the flat modal-shape to the normal modal-shape, by locking and maintaining a perpendicular relationship between said back portion and said pair of arm-rests for normal use, and to (2) respond to a predetermined user-manipulation of the bed lounge, in initiating a transition of said bed lounge from the normal modal-shape to the flat modal-shape, by unlocking and releasing said pair of arm-rests and thus enabling the arm-rests to be pivoted apart to a co-linear relationship with said back portion for purposes of convenient storage.

14. The dual-modal-shape bed lounge as defined in claim 13 wherein the two rear corner fold lines in said main support structure between the back portion and the arm-rests, said arm-rest shaping means and said spine hinge means comprise living hinges formed integrally by score lines configured in the plastic sheeting materials of the main support structure and the support spine.

* * * * *

UNITED STATES PATENT AND TRADEMARK OFFICE

CERTIFICATE OF CORRECTION

PATENT NO. : 7,284,290 B1
APPLICATION NO. : 11/240538
DATED : October 23, 2007
INVENTOR(S) : Robert L. Swezey and Richard Swezey It is certified that error appears in the above-identified patent and that said Letters Patent is hereby corrected as shown below:

At column 5 line 38: delete "direction" and insert therefor --directed--.

At column 6 line 8 (claim 1, first line): delete "A use-operable" and insert therefor --A dual-modal-shape bed lounge, that can be easily user-converted back and forth between a chair-like normal modal-shape for supporting a user in a sitting position and a generally flat modal-shape for convenient storage, comprising:

a generally flat back portion structured as a padding-covered flat back panel, disposed in a generally vertical plane, having a pair of opposite side edges and having a predetermined height dimension;

a pair of generally flat arm-rests structured as a corresponding pair of padding-covered flat side panels hingedly attached to said flat back panel throughout the predetermined height dimension along the side edges thereof in a foldable manner that enables said arm-rests to be moved between a first disposition extending forwardly from said back portion, generally perpendicular thereto, corresponding to the normal modal-shape and a second disposition wherein said arm-rests are made to extend outwardly from said back portion substantially co-planar therewith, corresponding to the generally flat modal-shape, and a user-operable--

At column 6 line 16: delete "lounged" and insert therefor --lounge--.

Signed and Sealed this

Fifteenth Day of April, 2008

JON W. DUDAS
*Director of the United States Patent and Trademark Office*